US006582094B2

(12) United States Patent
Liu

(10) Patent No.: US 6,582,094 B2
(45) Date of Patent: Jun. 24, 2003

(54) ROPE LIGHT STRUCTURE

(76) Inventor: Tzu-Chen Liu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/897,942

(22) Filed: Jul. 5, 2001

(65) Prior Publication Data

US 2003/0007349 A1 Jan. 9, 2003

(51) Int. Cl.[7] ..... F21S 4/00

(52) U.S. Cl. ..... 362/219; 362/249; 362/240; 362/252

(58) Field of Search ..... 362/219, 249, 362/806, 240, 236, 310, 252

(56) References Cited

U.S. PATENT DOCUMENTS 4,521,839 A * 6/1985 Cook et al. ..... 362/238
6,186,645 B1 * 2/2001 Camarota ..... 362/249
6,394,623 B1 * 5/2002 Tsui ..... 362/249

* cited by examiner

*Primary Examiner*—Sandra O'Shea
*Assistant Examiner*—Ali Alavi
(74) *Attorney, Agent, or Firm*—Troxell Law Office PLLC

(57) ABSTRACT

The present invention is directed to a plurality of light bulbs sets, are connected to a 2-core wiring, the positive end joints of the two sets of light bulbs, as well the negative end joints of two sets of light bulbs, are joined together by a process of twisting the two wires around each other, and in this way avoid the necessity of using soldering tin to weld the two wires together. One other part of the invention involves building an interior duct in the inside an outer PVC layer, so that flexible metal wire can be inserted into the interior duct, and in this way make the manufacturing process more efficient. Moreover, at the place where the outer level PVC layer connects to a female connector protruding type water-proofing is installed, and at the place the outer PVC layer connects to the male connector concave type water-proofing is installed.

2 Claims, 8 Drawing Sheets

ROPE LIGHT STRUCTURE

BACKGROUND OF THE INVENTION

1. Field of the Invention

The present invention is for the purpose of improving the structure of rope lights, specifically in respect to saving the amount of labor time needed to make light bulb connections, saving electricity, reducing the amount of soldering material needed, as well as increasing the elasticity of the body of the rope light, thus making the manufacturing process easier. The invention also involves waterproofing the body of the rope light, to ensure water or other liquids cannot enter, and thus helping to ensure that electrical accidents do not occur, and that the rope light performs more economically and efficiently, as well as being safer.

2. Description of the Prior Art

In respect to the structure of conventional rope lights refer to FIG. 1. In a conventional design a plurality of light bulbs are connected together in a series, so that a plurality of light bulbs are included in each light bulb set 10, and each light bulb set 10 includes both negative and positive connections, so that the two connecting joints (101, 102) are connected separately to the 2-core wiring 11, and that an inner layer of PVC is used to seal 2-core wiring 11, and a plurality of sets of light bulbs 10 are compactly connected via the hollow space provided in PVC layer 12, and that an outer layer of PVC 13 is placed over PVC 12, and the two layers are then sealed into one unit. One end of this outer PVC layer 13 is connected to a female connector 14, thus making a connection to 2-core wiring 11, and accompanying male connector 15 is connected to plug 16. To activate the rope light male connector 15 is connected to plug 16 so as to provide an electricity supply, and the light bulbs in light bulb set 10 are then lit up, and in this way providing a decorative lighting source, providing a source of light, as well as other functions.

In the process described above, a conventional rope light makes use of a welding process to connect the light bulbs in light bulb set 10, so that the negative and positive end joints (101, 102) are placed in contact with their respective connection points on 2-core wiring 11, and soldering tin is then used to weld the connection together. By connecting together light bulb set 10 with 2-core wiring 11 by means of welding, labor costs are increased, and, moreover, the noxious chemicals produce fumes that can cause damage to health. Moreover, besides wasting electricity, as the connections made by welders may some times be faulty, the connection between light bulb set 10 and 2-core wiring 11 can become disconnected, and in this way the rope light will loose its source of electricity. Thus in the context given above the use of welding to connect wires together is neither an economical or efficient means of implementing this task.

Moreover, during the process of assembling the rope light it is often the case that the metal wire has to be arranged in a way that mimics the shape of a certain object (such as a fish, flower, bird etc.), and in this kind of situation the only way of assembling the light is to attach the rope light to the shape made by the metal wire, creating a waste of both time and labor.

A further point that can be made is that in a conventional design the rope light's female connector 14 makes use of a concave shape to connect with the male connector's 15 protruding shape, and that in some instances the connection made between the male and female connectors can contain cracks, allowing water and other liquids to enter, thus creating a highly dangerous situation in respect to the possibility of electrical mishaps.

In accordance with the realization of the shortcomings and inconvenience of use created by the design of the standard rope light structure, a determined effort was made find a solution through the application of creative research, and to make use of professional judgement and knowledge to develop a design with a structure able to provide a practical solution as well as meeting the requirements of industry in terms of value for money.

SUMMARY OF THE INVENTION

The present invention provides a means of connecting a number of light bulbs with the 2-core wiring, so that the negative end joints of one set of light bulbs will connect to another set of light bulbs, as well as to the 2-core wiring, by twisting wires together to form a coiled spiral, and that the positive end joints of one set of light bulbs will connect to another set of light bulbs, as well as to the 2-core wiring, by twisting wires together to form a coiled spiral. Moreover, in the outer layer covering the internal insulating layer, an interior duct, fully integrated into the body of the PVC, will be made, so that a flexible metal wire can be placed inside this interior space, and a concave-type, protruding-type water-proofing will be installed on both sides of the female connector located on the end of the outer PVC layer, and concave-type water-proofing will be installed on both ends of the male connector located on the outer PVC layer, and in this way a secure connection will be made.

The main object of the invention is to replace the welding together of wires as a means of connection with the twisting together of wires into a single coil as a means of connection, and in this way reduce the labor time needed to make connections as well as the consumption of electrical power, reduce the amount of material needed to make these connections, and to ensure a flow of electricity is maintained.

The second object of this invention is to produce a design that will allow for an interior duct, fully integrated into the outer PVC layer, to be built into the PVC layer, so that a flexible metal wire can be placed inside, ensuring that the body of the rope light is fully flexible, and that the process of manufacturing the light is kept as trouble free as possible.

One other object of this invention is to supply the female connector with protruding-type water-proofing, and the male connection with concave-type water-proofing, and in this way improve on the design of the male and female connections in respect to the possibility of the inadvertent production of cracks. In this way it can guard against the possibility of water or other liquids entering the light, and prevent possible short circuits or inadvertent electrical discharges. In order to allow the inspector of this document to arrive at a clearer understanding of the aims, unique features, and functions of this invention, a detailed and comparative description of the invention will be provided along with accompanying graphic illustrations.

DETAILED DESCRIPTION OF THE PREFERRED EMBODIMENTS

Figure 1:
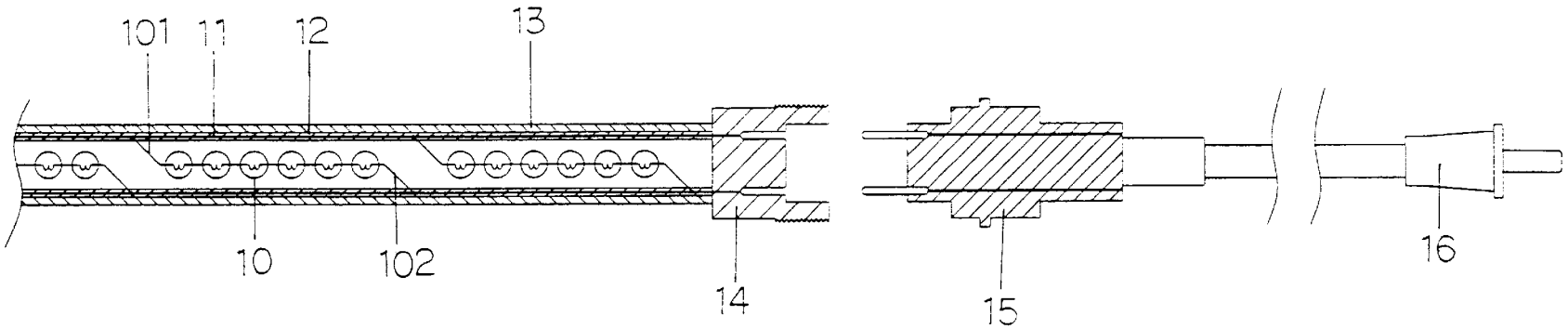
FIG.1 Prior Art
FIG. 1 is a cross sectional drawing of conventional rope light.
Figure 2:
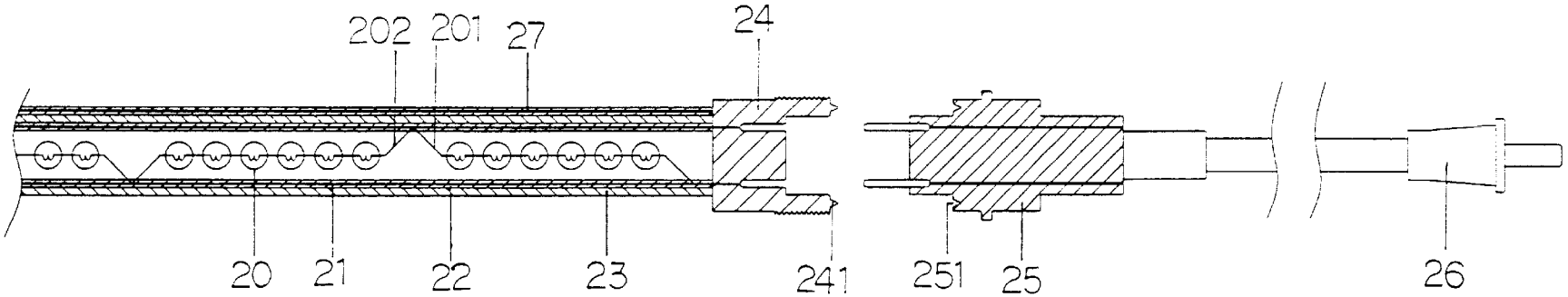
FIG. 2 is a cross sectional drawing of the present invention.

Firstly, please refer to FIG. 2, a cross sectional diagram, which shows how this invention involves a plurality of light bulbs joined together in a series and which have been divided into a number of sets 20, and that each set has a positive and a negative end joint (201, 202), so that each of these end joints is connected separately to the 2-core wiring 21, and that the 2-core wiring 21 is bundled by an inner and tube shaped PVC layer 22, and that connection connecting the set of light bulbs 20 is located in a hollow area inside PVC 22. This inner PVC layer 22 is covered by outer PVC layer 23, and the connection between the 2-core wiring 21 and the female connector 24 is located on the end of outer layer PVC 23. When the accompanying male connector 25 connects with plug 26, the light bulb set 20 is activated. Unique features of this design are as follows: When the set of light bulbs 20 is connected to the 2-core wiring 21, the positive and negative end joints 201, 202 of adjacent light bulb sets 20 are connected by a process of twisting the wires around each other, and connect also with 2-core wiring 21 in this manner, and in this way there is no need to use solder tin to connect the wires by means of welding.

Figure 3B:
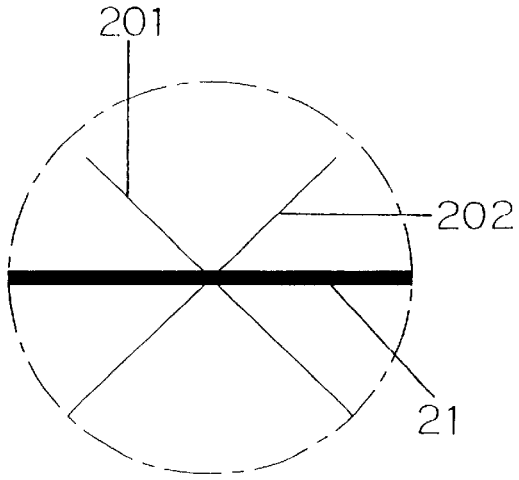
FIGS. 3A and 3B are schematic drawings of twisting of the light bulb connection.
Figure 3A:
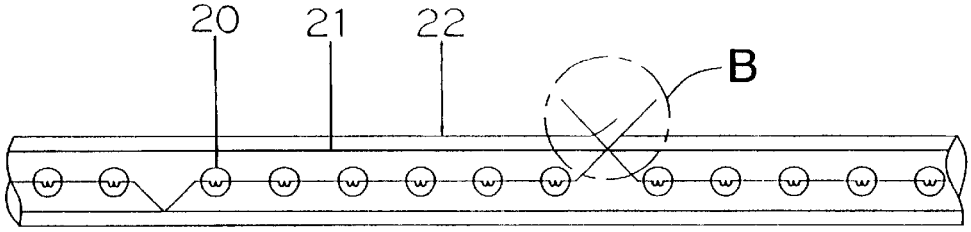
Figure 4B:
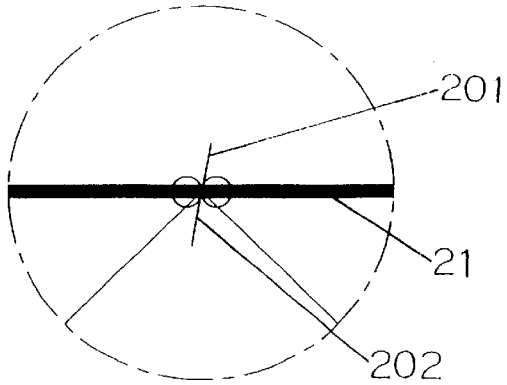
FIGS. 4A and 4B are schematic drawings of twisting of the light bulb connection.
Figure 4A:
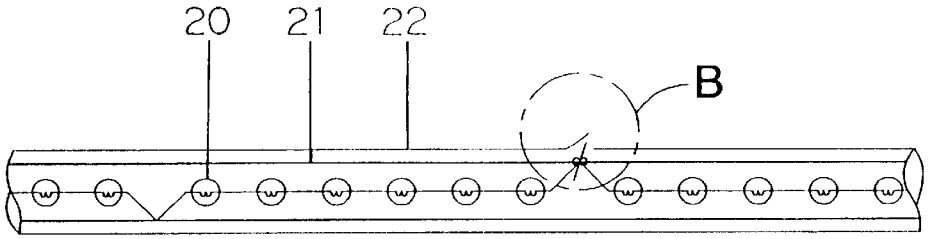
Figure 5B:
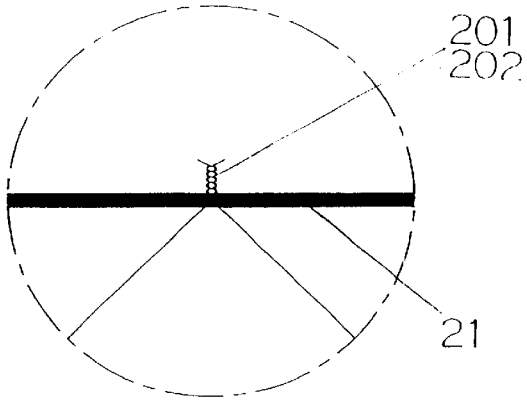
FIGS. 5A and 5B are schematic drawings of twisting of the light bulb connection.
Figure 5A:
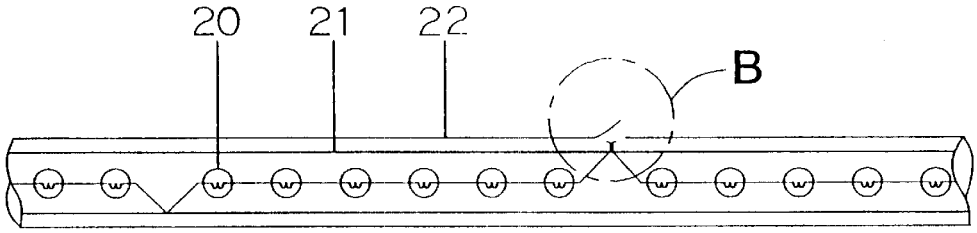
Figure 6B:
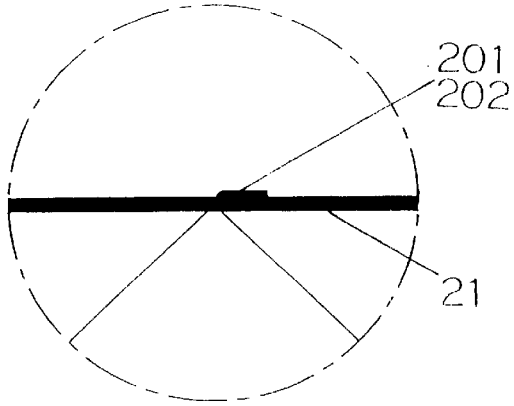
FIGS. 6A and 6B are schematic drawings of twisting of the light bulb connection.
Figure 6A:
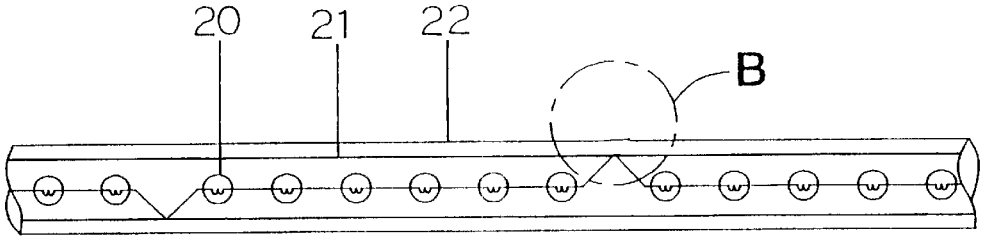

According to the above description, in respect to the present invention's set of light bulbs 20 the task of twisting the end wire together will be accomplished in a manner as described below: Firstly, bring the negative and positive ends of the end light bulbs in light bulb set 20 to a carved out space occupying 5 millimeters in the insulating area of PVC layer 22, then as depicted in FIGS. 3A and 3B, place 2-core wiring 21 in an outwardly pointing direction, then place together the two sets of negative end joints 201 and the two sets of positive end joints of the two sets of light bulb sets, as well as with the outwardly pointing 2-core wiring. Then twist core wire 21 so that it is pointing upwards at a high vertical angle, and then place it together with either positive end joint 201 or negative end joint 202, so that it connected together with the appropriate wire—either left or right facing—of the two outwardly facing 2-core wiring 21 wires, as is shown in FIGS. 4A and 4B. Then twist together the positive end joints 201 or the negative end joints 202 of the two sets of light bulbs 20, so as to produce a spiral-like, or figure of eight effect "8", as is shown in FIGS. 5A and 5B. Then use a strong pulling or dragging motion in respect to positive joint ends 201 or negative joint ends 202 so that positive joint ends 201 or negative joint ends 202 are connected together with 2-core wiring 21. Then use the same twisting technique described earlier to deal with any wire still protruding from positive joint end 201 or negative joint end 202, as is shown in FIGS. 6A and 6B. Cut any remaining wire and then press remaining spiral of wire down onto 2-core wire 21, and then cover up the connection with inner layer PVC 22.

Figure 7:
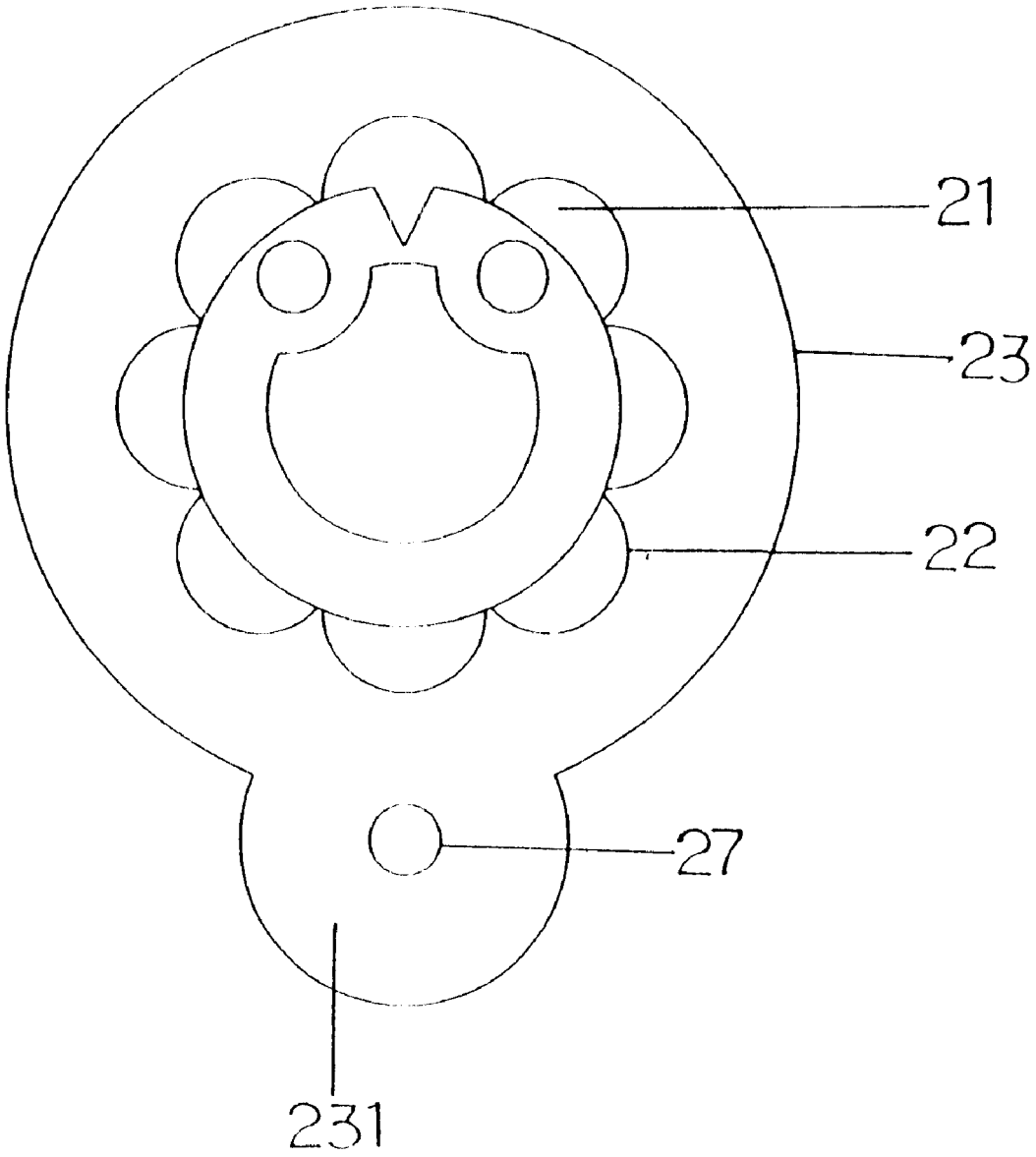
FIG. 7 is a cross sectional view drawing of the light rope.

Moreover, an interior duct 231 is made to run along the length of outer layer PVC 23, and in the empty space provided by interior duct 221 a flexible metal wire 27 will be inserted, and in this way the manufacturing process has been made easier and less trouble-prone, and as is shown in FIG. 7, duct 231 and outer PVC layer 23 will form a single unified whole.

Figure 8:
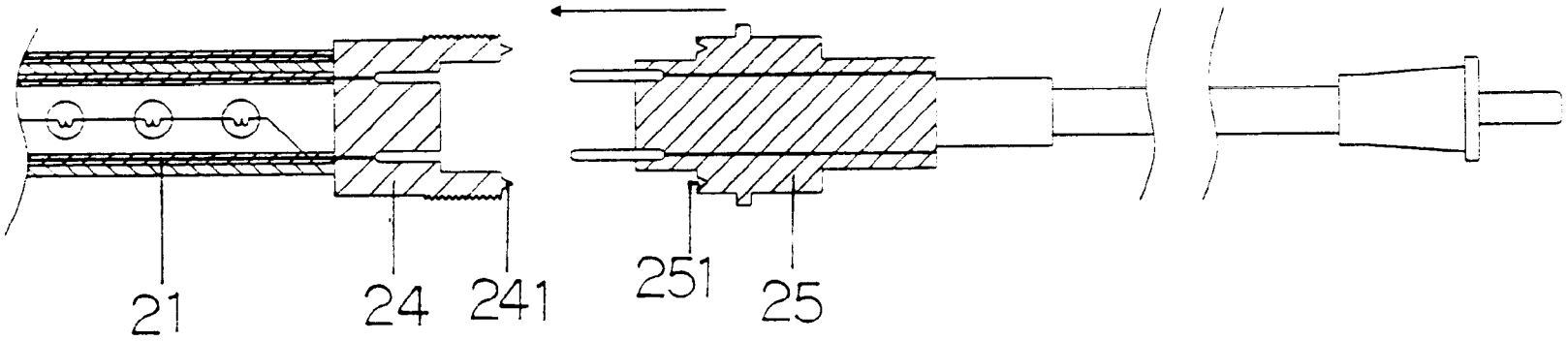
FIG. 8 is a cross sectional drawing of female and male connectors.

Moreover, protruding-type waterproofing 241 will be constructed on both sides of the female connector 24 on the end of outer PVC layer 23, and indented-type waterproofing 251 will be constructed on both sides of male connector 25, and by securing a tight connection water and other liquids will be prevented from entering the system. In this way, the danger of short circuiting or inadvertent discharge of electricity will be reduced, as is shown in FIG. 8.

(1) The way in which two sets of ten lights in the present invention will be joined together to form a single unit will reduce labor time by 100%.

(2) Because the present invention does away with the need to use welding to make connections, material costs will be reduced, wastage of electricity will be avoided, and the damage caused to health through the harmful fumes produced by noxious chemicals will be eliminated.

(3) Because the twisting together methods of connection used by the present invention do away with the need for welding, harmful or dangerous situations can be avoided, and an uninterrupted flow of electricity will be guaranteed.

(4) The way in which interior duct 231 and outer layer PVC 23 form a single unit in this invention will create a more flexible body, thus making the manufacturing process easier, as well as saving time and labor (5) The way in which the present invention insures that a secure connection between female and male connectors is made will prevent water or other liquids from entering the system, thus preventing damage from short-circuiting and ensuring the safety of the system.

To summarize the points made above, the improvements made by this invention in respect to the structure of rope lights provide greater efficiency as well as more economic use of resources, and represent a high degree of improvement and quality of design.

The enclosed descriptions and illustrations describe only the main conceptions of the present invention, and the scope of the present invention should not be limited by these descriptions.

What is claimed is:

1. A rope light structure comprising:

a) an elongated outer PVC layer having a hollow interior and an elongated duct formed on an outer side thereof separated from the hollow interior, the elongated duct extending along a length of the outer PVC layer;

b) a flexible wire located in the duct;

c) two electrical wires located within the outer PVC layer;

d) a plurality of sets of light bulbs located in the interior of the outer PVC layer, each light bulb set having positive and negative end joints connected to the two electrical wires solely by twisting;

e) an inner PVC layer located on the interior of the outer PVC layer and extending around the set of light bulbs such that the electrical wires are located between the inner and outer PVC layers; and f) an electrical connector connected to at least one end of the outer PVC layer.

2. The rope light structure of claim 1 further comprising a waterproofing protrusion extending from an end of the electrical connector.

* * * * *